US010699649B2

(12) United States Patent
Chen

(10) Patent No.: US 10,699,649 B2
(45) Date of Patent: Jun. 30, 2020

(54) DISPLAY DEVICE AND BACKLIGHT CONTROL METHOD

(71) Applicant: Qisda Corporation, Taoyuan (TW)

(72) Inventor: Min-Jye Chen, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 16/254,630

(22) Filed: Jan. 23, 2019

(65) Prior Publication Data

US 2019/0251914 A1 Aug. 15, 2019

(30) Foreign Application Priority Data

Feb. 12, 2018 (CN) ..... 2018 1 0144967

(51) Int. Cl.
*G09G 5/10* (2006.01)
*G09G 3/34* (2006.01)

(52) U.S. Cl.
CPC ..... *G09G 3/3426* (2013.01); *G09G 3/342* (2013.01); *G09G 2320/064* (2013.01); *G09G 2320/0633* (2013.01)

(58) Field of Classification Search
CPC ..... G09G 2320/0633; G09G 2320/064; G09G 3/342; G09G 3/3426
See application file for complete search history.

(56) References Cited

U.S. PATENT DOCUMENTS

2007/0229447 A1* 10/2007 Takahara ..... G09G 3/3406 345/102
2014/0218350 A1* 8/2014 Wee ..... G09G 3/20 345/212

FOREIGN PATENT DOCUMENTS

TW I433115 B 4/2014
TW 201705121 A 2/2018

OTHER PUBLICATIONS

Office action of counterpart application by Taiwan IP Office dated Mar. 29, 2019.
Office action of counterpart application by Taiwan IP Office dated Aug. 31, 2018.

* cited by examiner

*Primary Examiner* — Insa Sadio

(57) ABSTRACT

A display device including a display panel, a backlight unit, a display driving circuit, and a backlight driving circuit is provided. The display panel includes multiple display zones. The backlight unit includes multiple light sources corresponding to the multiple display zones respectively. The display driving circuit receives an image signal and calculates a local dimming value for each display zone according to the image signal. The image signal includes multiple image frames. The display driving circuit drives the display panel to display the multiple image frames sequentially in multiple frame intervals each including a vertical blanking interval and a data scan interval. The backlight driving circuit provides a backlight pulse for each light source and adjusts the width and/or the intensity of each backlight pulse according to the local dimming value for each display zone. The backlight driving circuit provides the backlight pulse in the vertical blanking interval.

20 Claims, 8 Drawing Sheets

DISPLAY DEVICE AND BACKLIGHT CONTROL METHOD

This application claims the benefit of People's Republic of China patent application Serial No. 201810144967.5, filed Feb. 12, 2018, the disclosure of which is incorporated herein by reference.

BACKGROUND OF THE INVENTION

Field of the Invention

The invention relates in general to a display device, and more particularly to a backlight control method used in a display device.

Description of the Related Art

Currently, the liquid crystal display (LCD) is the most commonly used display screen. The liquid crystal panel is a passive display, and therefore is unable to display an image without a backlight. The conversion of liquid crystal takes a certain amount of time. If the backlight is continuously provided, the conversion process of liquid crystal will be seen by the user and afterimages affecting viewing quality will be generated. Besides, the liquid crystal display is a hold type display device. That is, for each pixel, pixel intensity will remain at a fixed value until the intensity of the next image frame is updated to a new intensity. Due to the above characteristics, when displaying continuous image frames, the object moving in the image will remain still in an image frame, and may therefore generate a phenomenon of dynamic motion blur to the viewers, not only deteriorating image quality but also causing discomfort to the viewers' eyes. Therefore, how to resolve the phenomenon of dynamic motion blur of the display device has become a prominent task to the industries.

SUMMARY OF THE INVENTION

The present invention relates to a display device and a backlight control method thereof, which are capable of achieving local dimming and resolving the phenomenon of dynamic motion blur of the display device.

According to an embodiment of the present invention, a display device including a display panel, a backlight unit, a display driving circuit, and a backlight driving circuit is provided. The display panel includes multiple display zones. The backlight unit includes multiple light sources corresponding to the multiple display zones respectively. The display driving circuit is configured to receive an image signal and to calculate a local dimming value for each display zone according to the image signal. The image signal includes multiple image frames, and the display driving circuit is configured to drive the display panel to display the multiple image frames sequentially in multiple frame intervals, wherein each frame interval includes a vertical blanking interval and a data scan interval. The backlight driving circuit is configured to provide a backlight pulse for each light source and to adjust the width and/or the intensity of each backlight pulse according to the local dimming value for each display zone. The backlight driving circuit is configured to provide the backlight pulse in the vertical blanking interval.

According to another embodiment of the present invention, a backlight control method used in a display device is provided. The display device includes a display panel and a backlight unit. The backlight control method includes the following steps. The display panel is divided into multiple display zones, wherein the backlight unit includes multiple light sources corresponding to the multiple display zones respectively. An image signal including multiple image frames is received. The multiple image frames are displayed in the display panel sequentially in multiple frame intervals, wherein each frame interval includes a vertical blanking interval and a data scan interval. A local dimming value for each display zone is calculated according to the image signal. A backlight pulse is provided for each light source. The backlight pulse is provided in the vertical blanking interval. The width and/or the intensity of each backlight pulse is adjusted according to the local dimming value for each display zone.

The above and other aspects of the invention will become better understood with regard to the following detailed description of the preferred but non-limiting embodiment (s). The following description is made with reference to the accompanying drawings.

DETAILED DESCRIPTION OF THE INVENTION

A transmissive liquid crystal display may include a display panel and a backlight unit. The backlight unit includes a light source which illuminates the display panel disposed before the light source. The light source can be realized by such as light-emitting diodes (LED) or cold cathode fluorescent lamps (CCFL). Through the ON/OFF operation of the backlight unit (for example, the ON/OFF state of the backlight unit is controlled by a frequency outside the visible range of human eyes), liquid crystal pixels do not need to maintain at the light state during the complete period of image frame, such that the phenomenon of dynamic motion blur can be effectively reduced.

Figure 1:
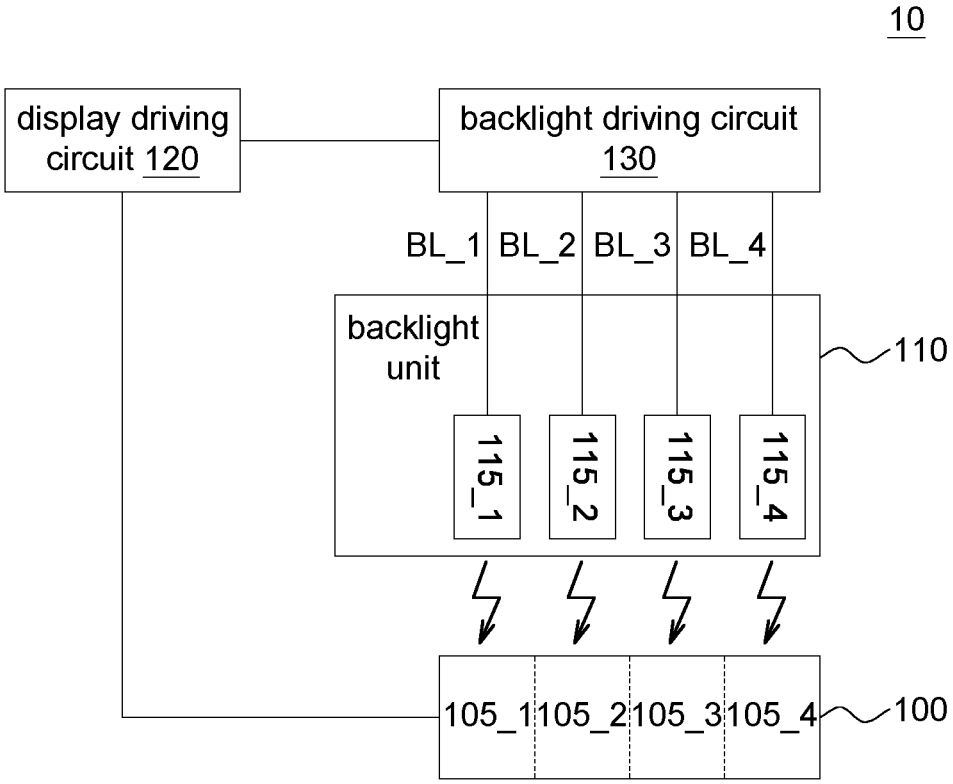
FIG. 1 is a schematic diagram of a display device according to an embodiment of the present invention.

FIG. 1 is a schematic diagram of a display device according to an embodiment of the present invention. The display device 10 includes a display panel 100, a backlight unit 110, a display driving circuit 120, and a backlight driving circuit 130. The display panel 100 includes multiple display zones 105_1~105_4. The backlight unit 110 includes multiple light sources 115_1~115_4. The multiple light sources 115_1~115_4 respectively correspond to the multiple display zones 105_1~105_4. The display driving circuit 120 is configured to receive an image signal and to calculate a local dimming value for each of the display zones 105_1~105_4 according to the image signal. The backlight driving circuit 130 is configured to provide the backlight pulses BL_1~BL_4 to each of the light sources 115_1~115_4 respectively and to adjust the width and/or the intensity of each of the backlight pulses BL_1~BL_4 according to the local dimming value for each of the display zones 105_1~105_4.

As indicated in FIG. 1, the backlight unit 110 includes four light sources 115_1~115_4 configured to illuminate four display zones 105_1~105_4 respectively. Through the disposition of the light sources 115_1~115_4 corresponding to the display zones 105_1~105_4, the effect of local dimming can be achieved, such that different display zones 105_1~105_4 can have different brightness levels and the contrast effect can be enhanced. The quantity of the light sources 115_1~115_4 matches that of the display zones 105_1~105_4 (the quantity is designated by n in the disclosure here below), and is exemplified by 4 in FIG. 1 (n=4). However, the above exemplification is for explanatory and exemplary purposes only, and the quantity of the light sources and that of the display zones can be other numbers in other embodiments.

Figure 2A:
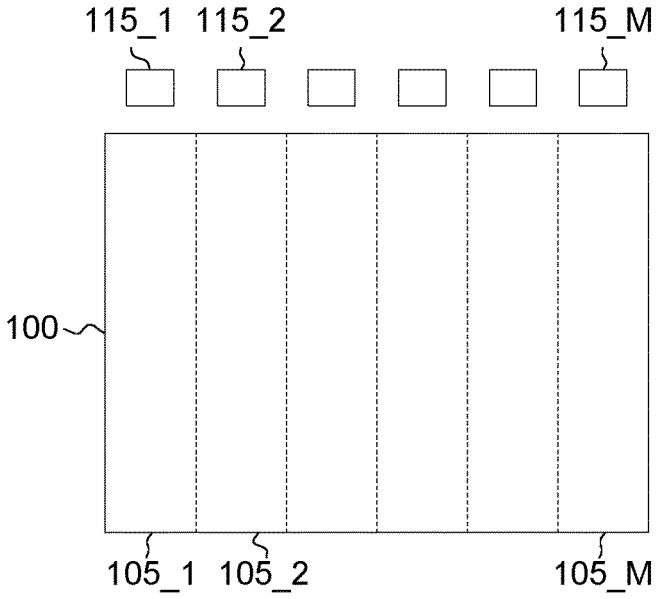
FIGS. 2A-2C are schematic diagrams of dividing a display panel into multiple display zones according to multiple embodiments of the present invention.
Figure 2B:
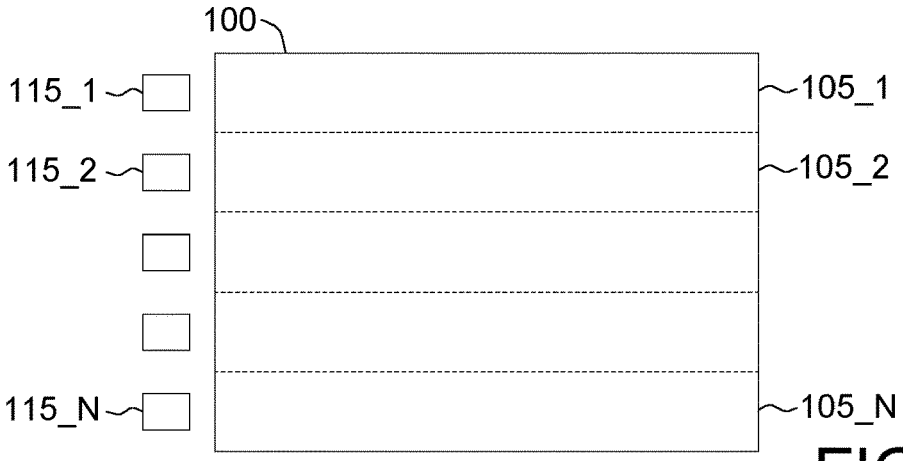
Figure 2C:
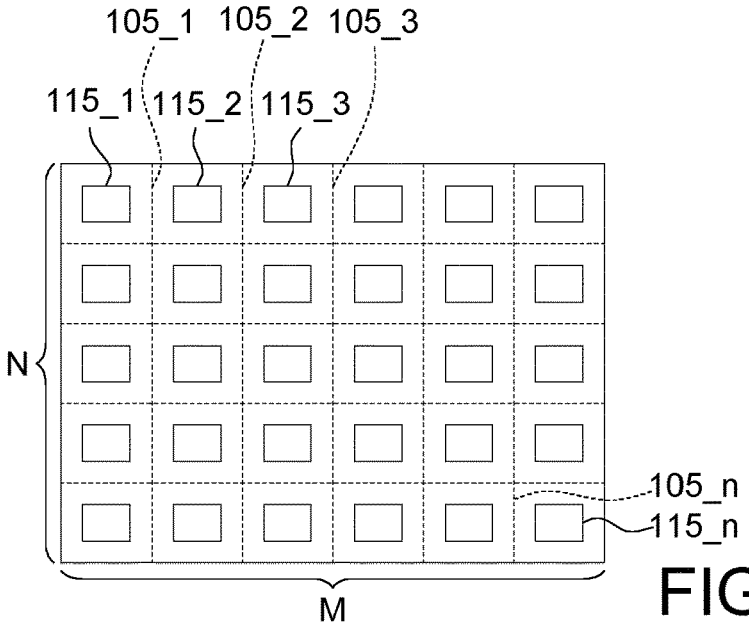

FIGS. 2A-2C are schematic diagrams of dividing a display panel into multiple display zones according to multiple embodiments of the present invention. In an embodiment as indicated in FIG. 2A, the display panel 100 is vertically divided into M display zones 105_1~105_M, and the light sources 115_1~115_M are disposed on the top side of the display panel 100, wherein M is a positive integer greater than 1, and n=M. In other embodiments, the light sources 115_1~115_M can be disposed on the bottom side or on both the top side and the bottom side of the display panel 100, and the present invention is not limited thereto. FIG. 2A is an example of left-and-right side-type backlights.

In an embodiment as indicated in FIG. 2B, the display panel 100 is horizontally divided into N display zones 105_1~105_N, and the light sources 115_1~115_N are disposed on the left side of the display panel 100, wherein N is a positive integer greater than 1, and n=N. In other embodiments, the light sources 115_1~115_N can be disposed on the right side or both the left side and the right side of the display panel 100, and the present invention is not limited thereto. FIG. 2B is an example of left-and-right side-type backlights.

In an embodiment as indicated in FIG. 2C, the display panel 100 is divided into M×N display zones 105_1~105_n having M columns and N rows. For example, the display panel 100 is divided into multiple rectangular zones arranged in two dimensions. All display zones 105_1~105_n are rectangular, and respectively are disposed at positions corresponding to the display zones 105_1~105_n, wherein both M and N are positive integers greater than 1, n=M×N. FIG. 2C is an example of direct-type backlights.

Figure 3:
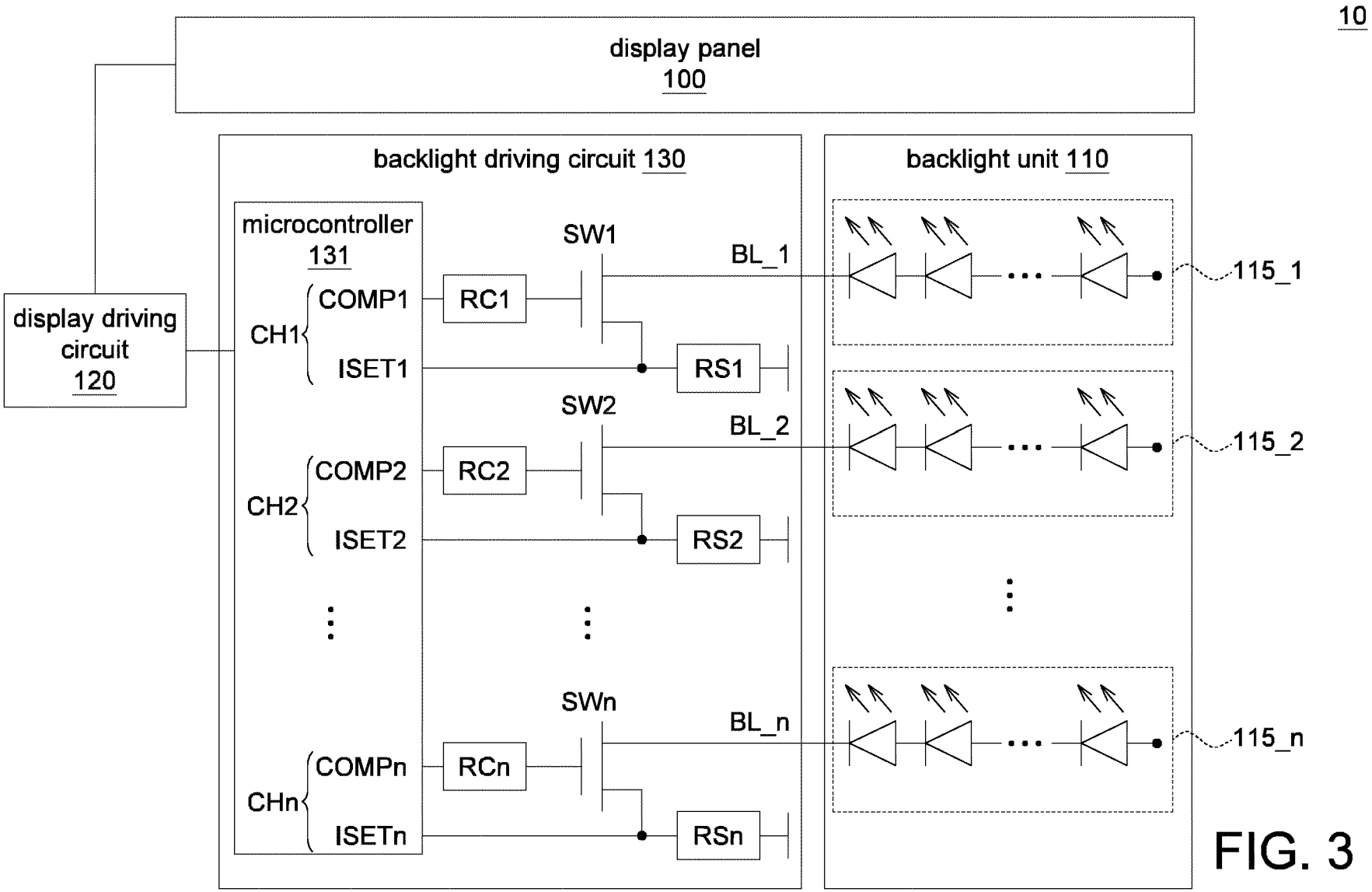
FIG. 3 is a circuit diagram of a backlight unit and a backlight driving circuit according to an embodiment of the present invention.

FIG. 3 is a circuit diagram of a backlight unit and a backlight driving circuit according to an embodiment of the present invention. In the present embodiment, each of the light sources 115_1~115_n includes multiple LED light bars. The backlight driving circuit 130 includes a microcontroller 131, multiple switches SW1~SWn, multiple pulse width modulation circuits RC1~RCn, and multiple current modulation circuits RS1~RSn. In an embodiment, the microcontroller 131 can be replaced by a microprocessor or a digital signal processor (DSP). The switches SW1~SWn respectively correspond to the light sources 115_1~115_n. The microcontroller 131 includes multiple leads COMP1, COMP2, . . . , COMPn, and multiple leads ISET1, ISET2, . . . , ISETn, wherein the leads COMP1 and ISET1 correspond to the channel CH1 and the light source 115_1, the leads COMP2 and ISET2 correspond to the channel CH2 and the light source 115_2, and the rest can be obtained by the same analogy. By adjusting the waveform of the signal outputted to the leads COMP1~COMPn, the microcontroller 131 can control the pulse width modulation circuits RC1~RCn and change the turn-on duration of the switches SW1~SWn to change the width of the backlight pulses BL_1~BL_n transmitted to the light sources 115_1~115_n. Besides, the microcontroller 131 can further adjust the voltage outputted to the leads ISET1~ISETn to have different potentials of the current modulation circuits RS1~RSn and change the LED driving current of the light sources 115_1~115_n to change the intensity of the backlight pulses BL_1~BL_n transmitted to the light sources 115_1~115_n. In an embodiment, the current modulation circuits RS1~RSn can be replaced by multiple voltage modulation circuits, and the bias of the light sources 115_1~115_n can be adjusted to change the intensity of the backlight pulses BL_1~BL_n. The display driving circuit 120, configured to receive an image signal, includes a scalar circuit.

Figure 4:
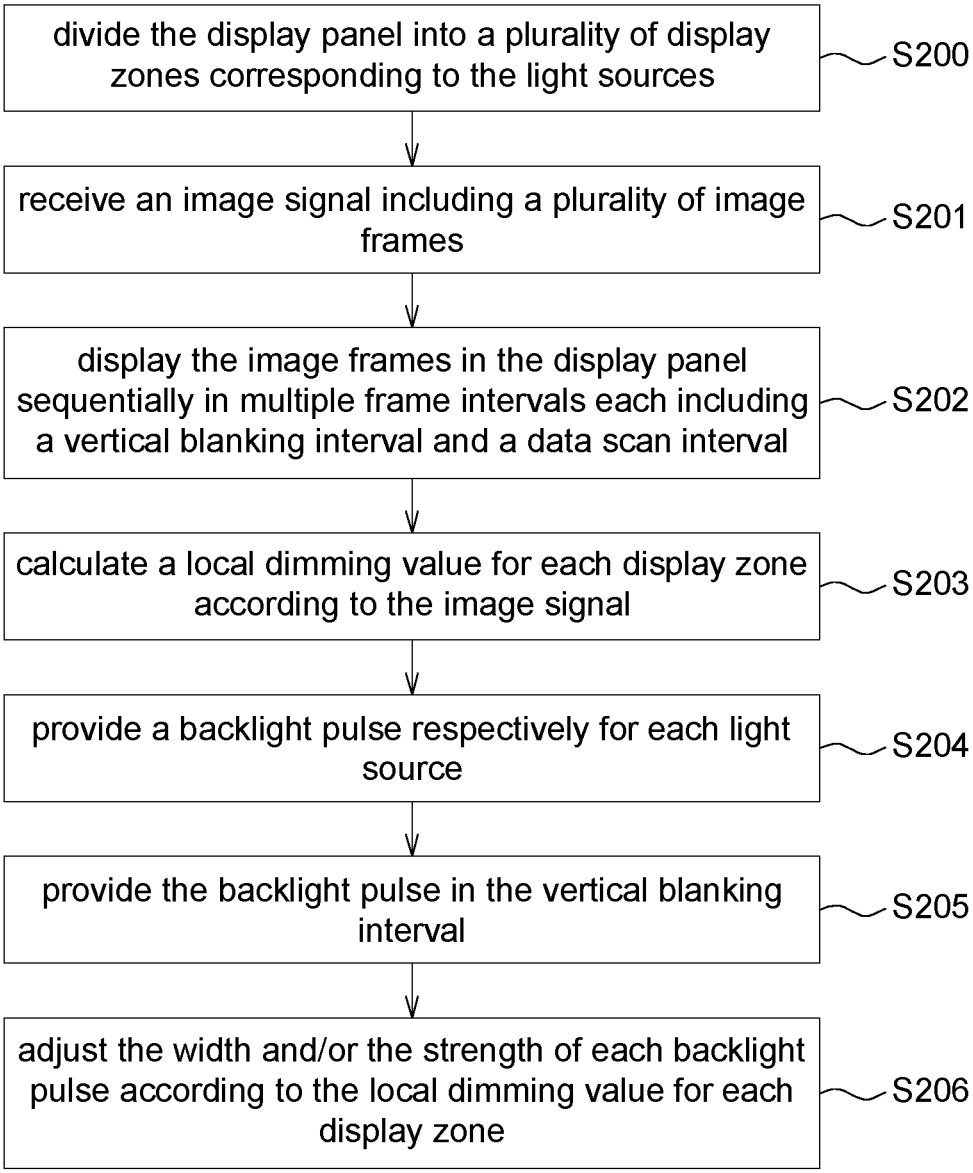
FIG. 4 is a flowchart of a backlight control method according to an embodiment of the present invention.

FIG. 4 is a flowchart of a backlight control method according to an embodiment of the present invention. The backlight control method can be used in the display device 10 of FIG. 1. The backlight control method includes the following steps. In step S200: the display panel is divided into multiple display zones, wherein the backlight unit includes multiple light sources corresponding to the multiple display zones respectively. The multiple embodiments of step S200 are illustrated with reference to FIGS. 2A-2C.

In step S201: an image signal is received, wherein the image signal includes multiple image frames. In step S202: the multiple image frames are displayed in the display panel 100 sequentially in multiple frame intervals, wherein each frame interval includes a vertical blanking interval VBI and a data scan interval. Steps S201 and S202 can be performed by the display driving circuit 120. Step S202 may include driving the display panel 100 by a display driving circuit 120 to display the multiple image frames sequentially in the multiple frame intervals.

In step S203: a local dimming value for each of the display zones 105_1~105_n is calculated according to the image signal. In step S204: the backlight pulses BL_1~BL_n are provided to the light sources 115_1~115_n respectively. In step S205: the backlight pulse is provided in the vertical blanking intervals BL_1~BL_n. In step S206: the width and/or the intensity of each of the backlight pulses BL_1~BL_n are adjusted according to the local dimming value for each of the display zones 105_1~105_n. In an embodiment, step S203 of calculating the local dimming value can be performed by the display driving circuit 120, and steps S204~S206 can be performed by the backlight driving circuit 130. In another embodiment, step S203 can also be performed by the backlight driving circuit 130.

Since each frame interval includes a vertical blanking interval and the backlight unit is intermittently turned on according to the backlight pulse, the backlight unit does not need to continuously illuminate the display panel and the phenomenon of dynamic motion blur is effectively reduced. Moreover, the width and/or the intensity of the backlight pulse are adjusted according to the local dimming value for each display zone, such that the effect of local dimming can be achieved and image contrast can therefore be enhanced.

Step S203 of calculating the local dimming value may have multiple embodiments. In an embodiment, the display driving circuit 120 is configured to calculate an average value of multiple pixel grey values of the image signal in each of the display zones 105_1~105_n and to calculate a local dimming value according to the average value. For example, a larger local dimming value is set for a larger average value of the pixel grey values. The display driving circuit 120 may set the local dimming value for the display zone 105_1 according to average value of the pixel grey values in the display zone 105_1 and set the local dimming value for the display zone 105_2 according to the average value of the pixel grey values in the display zone 105_2, and the rest can be obtained by the same analogy. In another embodiment, the display driving circuit 120 is configured to calculate the average value, a maximum and a minimum of the pixel grey values of the image signal in each of the display zones 105_1~105_n and to calculate the local dimming value according to the average value, the maximum, and the minimum. For example, the display driving circuit 120 may set respective weights for the three parameters, namely, the average value, the maximum, and the minimum, and then calculate the local dimming value according to the weighted sum of the three parameters.

Figure 5:
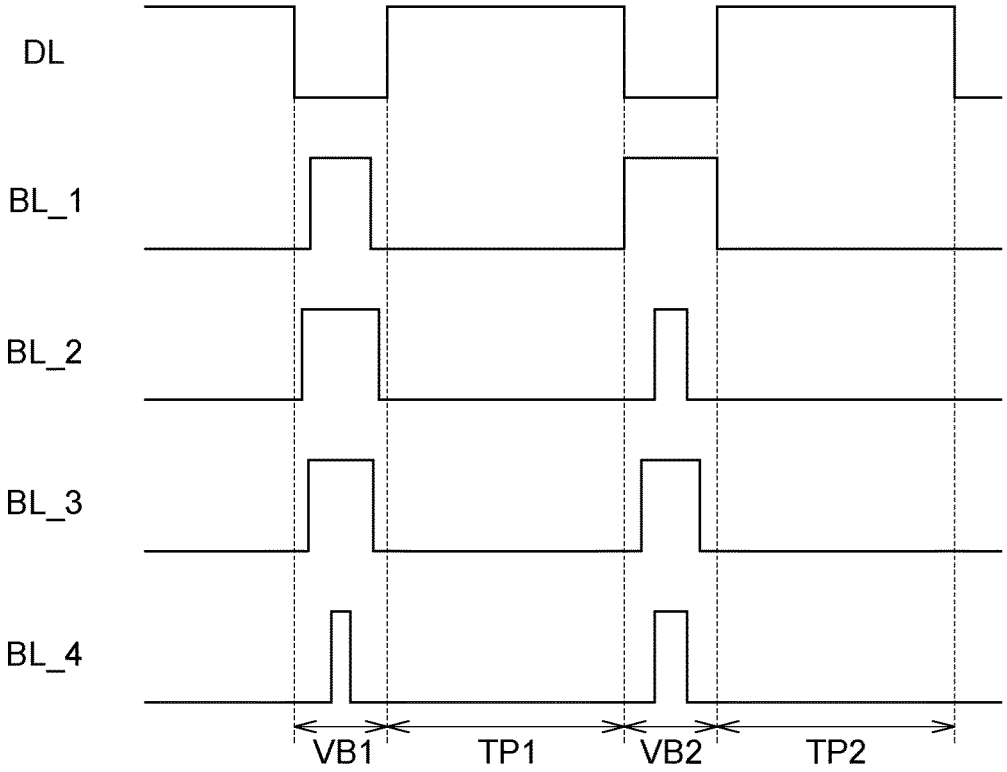
FIG. 5 is a schematic diagram of adjusting the width of a backlight pulse according to an embodiment of the present invention.

In an embodiment of step S206, the width of each of the backlight pulses BL_1~BL_n can be adjusted according to the local dimming value for each of the display zones 105_1~105_n, and the intensity of each of the backlight pulses BL_1~BL_n remains the same. FIG. 5 is a schematic diagram of adjusting the width of a backlight pulse according to an embodiment of the present invention. In an embodiment as indicated in FIG. 5, the image data timing signal DL is enabled during data scan periods TP1 and TP2, and the image data can be provided to the display panel 100 during the data scan periods TP1 and TP2; the image data timing signal DL is disabled during the vertical blinding periods VB1 and VB2, and the backlight driving circuit 130 provides the backlight pulses BL_1~BL_4 during the vertical blinding periods VB1 and VB2. The pulse intensity of the backlight pulses BL_1~BL_4 can be the same (as indicated in FIG. 5, the waveforms have the same height), the backlight driving circuit 130 is configured to adjust the width of each of the backlight pulses BL_1~BL_4 according to the local dimming value for each of the display zones 105_1~105_4. For example, a larger backlight pulse width can be assigned to a larger local dimming value to achieve a higher brightness level.

Figure 6:
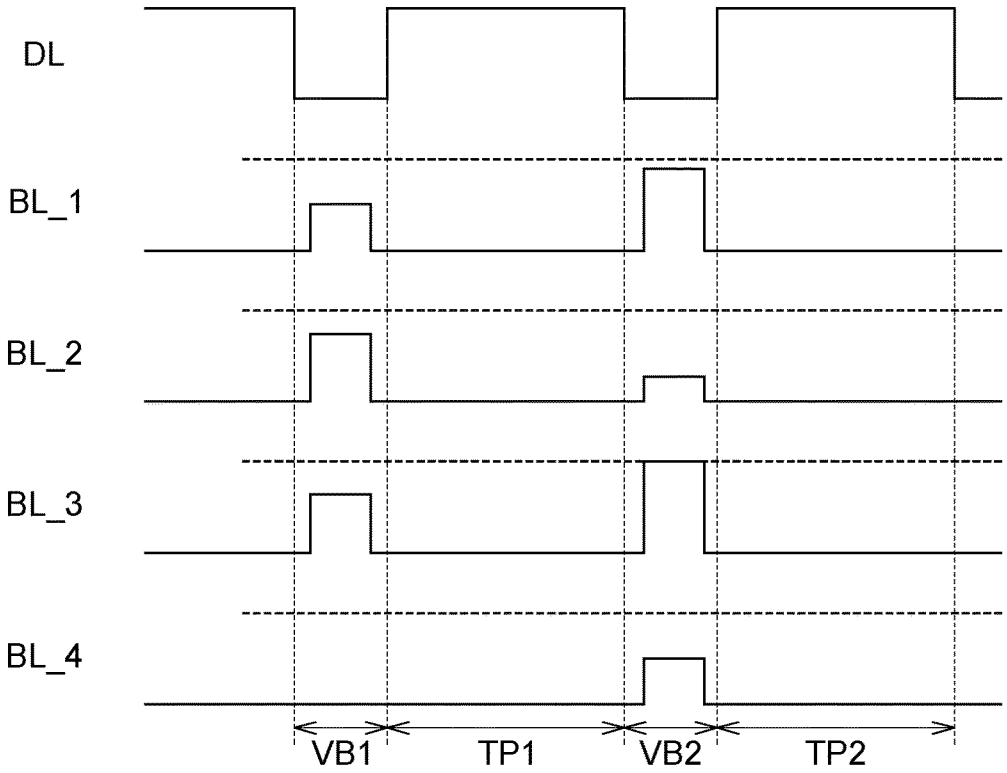
FIG. 6 is a schematic diagram of adjusting the intensity of a backlight pulse according to an embodiment of the present invention.

In another embodiment of step S206, the intensity of each of the backlight pulses BL_1~BL_n is adjusted according to the local dimming value for each of the display zones 105_1~105_n, and the width of each of the backlight pulses BL_1~BL_n remains the same. FIG. 6 is a schematic diagram of adjusting the intensity of a backlight pulse according to an embodiment of the present invention, wherein the pulse width of each of the backlight pulses BL_1~BL_4 can be same. The backlight driving circuit 130 is configured to adjust the intensity of each of the backlight pulses BL_1~BL_4 according to the local dimming value for each of the display zones 105_1~105_4. In the waveform of each of the backlight pulses BL_1~BL_4 as indicated in FIG. 6, the horizontal dotted line represents the largest pulse intensity of the backlight pulse, the backlight pulses BL_1~BL_4 can have different intensities, and a backlight pulse can have intensities in different vertical blinding periods VB1 and VB2. For example, a larger backlight pulse intensity can be assigned to a larger local dimming value to achieve a higher brightness level.

Figure 7:
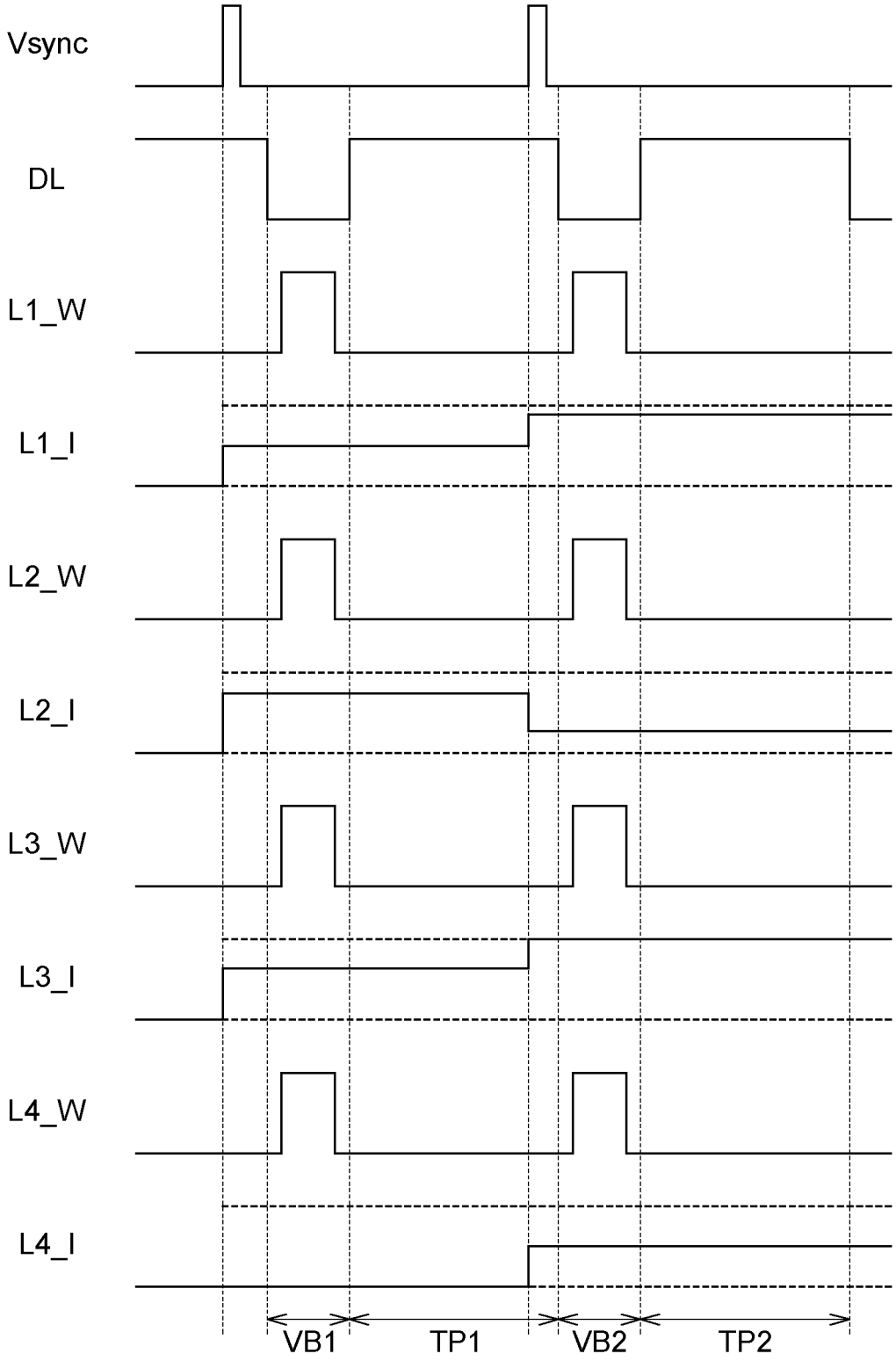
FIG. 7 is a schematic diagram of controlling the turn-on duration of each light source and driving the current according to an embodiment of the present invention.

An embodiment of adjusting the backlight pulse intensity as indicated in FIG. 6 is illustrated with reference to FIG. 7 being a schematic diagram of controlling the turn-on duration of each light source and driving the current according to an embodiment of the present invention. In the embodiment as indicated in FIG. 7, relevant control signals further include a vertical synchronization signal Vsync configured to control the driving timing of a display signal. In an embodiment, the display driving circuit 120, after having received the vertical synchronization signal Vsync and confirmed that the data of the entire image are ready, calculates a local dimming value for each of the display zones 105_1~105_4, and then the backlight driving circuit 130 generates the backlight pulses BL_1~BL_4 according to the local dimming value. In the embodiment as indicated in FIG. 7, the backlight driving circuit 130 can control respective light source turn-on durations L1_W, L2_W, L3_W, and L4_W to remain the same, and the backlight driving circuit 130 can set respective light source driving currents L1_I, L2_I, L3_I, and L4_I according to the local dimming value for each of the display zones 105_1~105_4. The light source turn-on duration L1_W and the light source driving current L1_I as indicated in FIG. 7 can generate the backlight pulse BL_1 as indicated in FIG. 6. Similarly, the light source turn-on duration L2_W and the light source driving current L2_I can generate the backlight pulse BL_2, and the rest can be obtained by the same analogy. In the present embodiment, the light source the turn-on durations L1_W, L2_W, L3_W, and L4_W are the same, and the backlight pulses BL_1~BL_4 can have the same duty cycle. That is, in the embodiment as indicated in FIG. 7, through the design of a fixed duty cycle and variable currents, local dimming can be achieved and the phenomenon of dynamic motion blur can be reduced.

In an embodiment, the backlight pulses BL_1~BL_4 have the same start time in each frame interval. The start time of the backlight pulses BL_1~BL_4 corresponds to the rising edge of the backlight pulses BL_1~BL_4. Refer to the embodiment as indicated in FIG. 7. Each of the light source turn-on durations L1_W, L2_W, L3_W, and L4_W and the vertical synchronization signal Vsync can have the same delay amount. In each frame interval, the delay amount remains unchanged, and the turn-on timing of the light source can be controlled according to the vertical synchronization signal Vsync. However, the above exemplification is for exemplary purpose only. In other embodiments, the start time of the backlight pulses BL_1~BL_4 may be different in each frame interval.

Figure 8A:
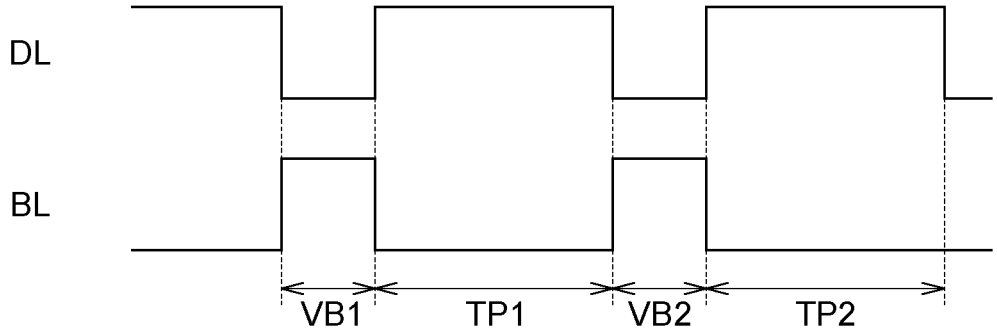
FIGS. 8A-8E are waveforms of a backlight pulse signal having different timing sequences according to multiple embodiments of the present invention.
Figure 8B:
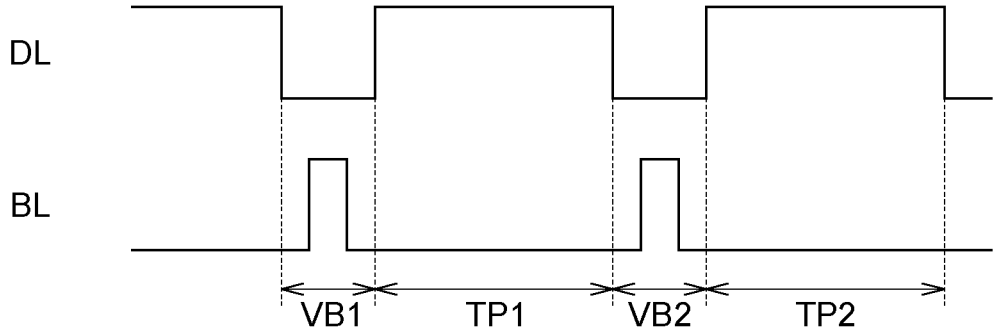
Figure 8C:
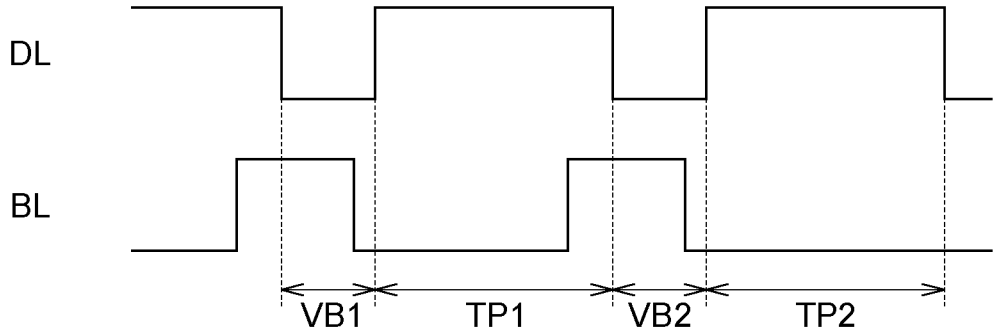
Figure 8D:
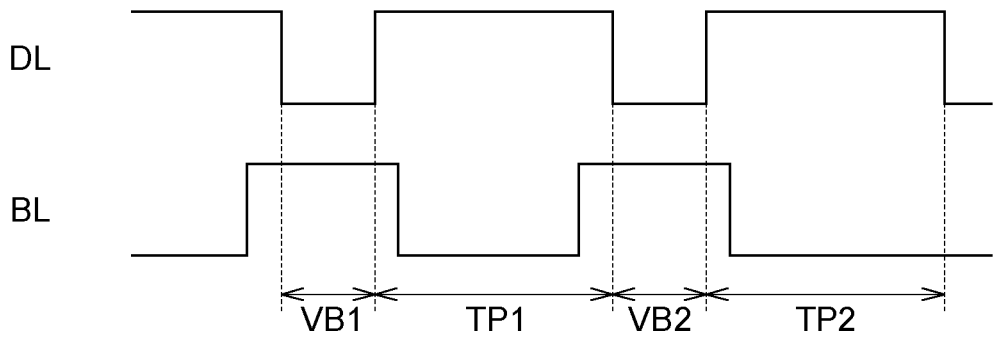
Figure 8E:
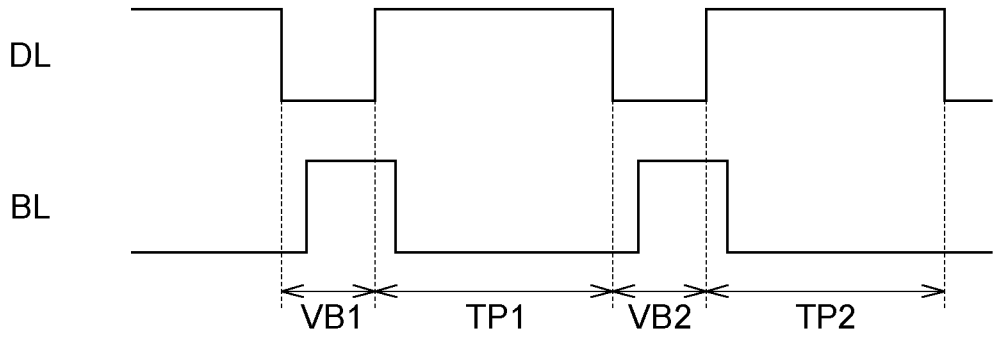

Step S205 of providing the backlight pulse in the vertical blanking interval by the backlight driving circuit 130 can have multiple embodiments. FIGS. 8A-8E are waveforms of a backlight pulse signal having different timing sequences according to multiple embodiments of the present invention. In the embodiment as indicated in FIG. 8A, the width of the backlight pulse BL (the backlight pulse BL can represent the backlight pulses BL_1~BL_4 of FIG. 5 and FIG. 6, and similar descriptions are not repeated hereinafter) is the same as the width of the vertical blanking interval VB1 (the vertical blanking interval VB1 can represent the vertical blanking interval VB1 and VB2, and similar descriptions are not repeated hereinafter). In the embodiment as indicated in FIG. 8B, both the start time and the end time of the backlight pulse BL fall within the vertical blanking interval VB1; the end time of the backlight pulse BL corresponds to the falling edge of the backlight pulse BL; the width of the backlight pulse BL is smaller than the width of the vertical blanking interval VB1. In the embodiment as indicated in FIG. 8C, the start time of the backlight pulse BL falls outside the vertical blanking interval VB1; the end time of the backlight pulse BL falls within the vertical blanking interval VB1. In the embodiment as indicated in FIG. 8D, both the start time and the end time of the backlight pulse BL fall outside the vertical blanking interval VB1; the width of the backlight pulse BL is larger than the width of the vertical blanking interval VB1. In the embodiment as indicated in FIG. 8E, the start time of the backlight pulse BL falls within the vertical blanking interval VB1; the end time of the backlight pulse BL falls outside the vertical blanking interval VB1. In the embodiments as indicated in FIGS. 8C-8E, the enabling time of the backlight pulse BL may partially overlap the data scan period TP1. The backlight driving circuit 130 can control the backlight pulse BL like the embodiments as indicated in FIGS. 8A-8E. In these embodiments, the enabling time of the backlight pulse BL at least partially overlaps the vertical blanking interval VB1, such that the phenomenon of dynamic motion blur can be reduced.

According to the display device and the backlight control method disclosed in above embodiments of the present disclosure, multiple light sources are disposed at positions corresponding to multiple display zones, and a diming value for each display zone is calculated according to the image data, such that the effect of local dimming can be achieved. For example, a brighter backlight is provided to a display zone having a higher brightness level to enhance image contrast. Besides, the width and/or the intensity of the backlight pulse can be adjusted according to the local dimming value, the turn-on duration and the driving intensity of the backlight unit can be suitably arranged such that the effect of local dimming can be achieved and at the same time the phenomenon of dynamic motion blur can be reduced. The above embodiments disclosed in the present disclosure can be used in the multiple zone dimming of the top down side-type backlight units, the left-and-right side-type backlight units and the direct-type backlight units, and can be adapted to relevant electronic display products such as personal computers, notebook computers, tablet devices, TVs, and projectors. The present disclosure has a wide range of application.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display device comprising:

a display panel comprising a plurality of display zones;

a backlight unit comprising a plurality of light sources corresponding to the display zones respectively;

a display driving circuit configured to receive an image signal and to calculate a local dimming value for each display zone according to the image signal, wherein the image signal comprises a plurality of image frames, and the display driving circuit is configured to drive the display panel to display the image frames sequentially in a plurality of frame intervals each comprising a vertical blanking interval and a data scan interval; and a backlight driving circuit configured to provide a backlight pulse respectively for each light source and to adjust the width and/or the intensity of each backlight pulse according to the local dimming value for each display zone, wherein the backlight driving circuit is configured to provide the backlight pulse in the vertical blanking interval.

2. The display device according to claim 1, wherein the width of each backlight pulse is the same, and the backlight driving circuit is configured to adjust the intensity of each backlight pulse according to the local dimming value for each display zone.

3. The display device according to claim 1, wherein the intensity of each backlight pulse is the same, and the backlight driving circuit is configured to adjust the width of each backlight pulse according to the local dimming value for each display zone.

4. The display device according to claim 1, wherein the width of the backlight pulse is the same as the width of the vertical blanking interval; or, the width of the backlight pulse is smaller than the width of the vertical blanking interval.

5. The display device according to claim 1, wherein one of a start time and an end time of the backlight pulse falls outside the vertical blanking interval.

6. The display device according to claim 1, wherein both of a start time and an end time of the backlight pulse fall outside the vertical blanking interval.

7. The display device according to claim 1, wherein the display panel is vertically divided into M display zones, the light sources are disposed on at least one of the top side and the bottom side of the display panel, and M is a positive integer greater than 1; or, the display panel is horizontally divided into N display zones, the light sources are disposed on at least one of the left side and the right side of the display panel, and N is a positive integer greater than 1.

8. The display device according to claim 1, wherein the display panel is divided into M×N display zones having M columns and N rows, the display zones are rectangular, the light sources are disposed at positions corresponding to the display zones, both M and N are positive integers greater than 1.

9. The display device according to claim 1, wherein the display driving circuit is configured to calculate an average value of a plurality of pixel grey values of the image signal in each display zone and to calculate the local dimming value according to the average value.

10. The display device according to claim 1, wherein the display driving circuit is configured to calculate an average value, a maximum and a minimum of a plurality of pixel grey values of the image signal in each display zone and to calculate the local dimming value according to the average value, the maximum, and the minimum.

11. The display device according to claim 1, wherein the backlight driving circuit comprises:

a pulse width modulation circuit configured to adjust the width of the backlight pulse; and a current modulation circuit configured to adjust the intensity of the backlight pulse.

12. A backlight control method used in a display device, the display device comprising a display panel and a backlight unit, and the backlight control method comprising:

dividing the display panel into a plurality of display zones, wherein the backlight unit comprises a plurality of light sources corresponding to the display zones respectively;

receiving an image signal comprising a plurality of image frames;

displaying the image frames in the display panel sequentially in a plurality of frame intervals, wherein each frame interval comprises a vertical blanking interval and a data scan interval;

calculating a local dimming value for each display zone according to the image signal;

providing a backlight pulse respectively for each light source;

providing the backlight pulse in the vertical blanking interval; and adjusting the width and/or the intensity of each backlight pulse according to the local dimming value for each display zone.

13. The backlight control method according to claim 9, wherein the width of each backlight pulse is the same, and the intensity of each backlight pulse is adjusted according to the local dimming value for each display zone.

14. The backlight control method according to claim 9, wherein the intensity of each backlight pulse is the same, and the width of each backlight pulse is adjusted according to the local dimming value for each display zone.

15. The backlight control method according to claim 9, wherein the width of the backlight pulse is the same as the width of the vertical blanking interval; or, the width of the backlight pulse is smaller than the width of the vertical blanking interval.

16. The backlight control method according to claim 9, wherein one of a start time and an end time of the backlight pulse falls outside the vertical blanking interval.

17. The backlight control method according to claim 9, wherein both of a start time and an end time of the backlight pulse fall outside the vertical blanking interval.

18. The backlight control method according to claim 9, wherein the step of dividing the display panel into the display zones comprises:

vertically dividing the display panel into M display zones, wherein the light sources are disposed at least one of the top side and the bottom side of the display panel, and M is a positive integer greater than 1; or, horizontally dividing the display panel into N display zones, wherein the light sources are disposed on at least one of the left side and the right side of the display panel, and N is a positive integer greater than 1.

19. The backlight control method according to claim 9, wherein the step of dividing the display panel into the display zones comprises:

dividing the display panel into M×N display zones having M columns and N rows, wherein the display zones are rectangular, the light sources are disposed at positions corresponding to the display zones, and both M and N are positive integers greater than 1.

20. The backlight control method according to claim 9, wherein the step of calculating the local dimming value for each display zone comprises:

calculating an average value of a plurality of pixel grey values of the image signal in each display zone and calculating the local dimming value according to the average value; or, calculating the average value, a maximum and a minimum of a plurality of pixel grey values of the image signal in each display zone and calculating the local dimming value according to the average value, the maximum, and the minimum.

* * * * *